US011654650B2

(12) United States Patent
Picchi et al.

(10) Patent No.: US 11,654,650 B2
(45) Date of Patent: May 23, 2023

(54) EMBOSSING AND LAMINATION ASSEMBLY AND RELATIVE EMBOSSING AND LAMINATION METHOD

(71) Applicant: GAMBINI S.P.A., Milan (IT)

(72) Inventors: Fabio Picchi, Lammari (IT); Giovanni Buffa, Ponte Buggianese (IT)

(73) Assignee: GAMBINI S.P.A., Milan (IT)

( * ) Notice: Subject to any disclaimer, the term of this patent is extended or adjusted under 35 U.S.C. 154(b) by 91 days.

(21) Appl. No.: 16/886,991

(22) Filed: May 29, 2020

(65) Prior Publication Data

US 2020/0384718 A1 Dec. 10, 2020

(30) Foreign Application Priority Data

Jun. 5, 2019 (IT) ..... 102019000008079

(51) Int. Cl.
*B31F 1/07* (2006.01)
*D21H 27/00* (2006.01)
*D21H 27/02* (2006.01)

(52) U.S. Cl.
CPC ..... *B31F 1/07* (2013.01); *B31F 2201/0728* (2013.01); *B31F 2201/0733* (2013.01); *B31F 2201/0738* (2013.01); *B31F 2201/0761* (2013.01); *B31F 2201/0787* (2013.01); *D21H 27/002* (2013.01); *D21H 27/02* (2013.01)

(58) Field of Classification Search
None
See application file for complete search history.

(56) References Cited

U.S. PATENT DOCUMENTS 3,556,907 A 1/1971 Nystrand
3,867,225 A * 2/1975 Nystrand ..... D21H 27/40 156/219

(Continued)

FOREIGN PATENT DOCUMENTS

DE 101 37 116 A1 2/2003
EP 1 996 395 12/2008

(Continued)

OTHER PUBLICATIONS

Italian Search Report dated Jan. 27, 2020 in Italian Application 102019000008079 filed on Jun. 5, 2019 (with Written Opinion & English Translation of Categories of Cited Documents), 8 pages.

(Continued)

*Primary Examiner* — Barbara J Musser
(74) *Attorney, Agent, or Firm* — Oblon, McClelland, Maier & Neustadt, L.L.P.

(57) ABSTRACT

An embossing and lamination assembly including two pairs of steel/rubber rolls, between which respectively a first paper ply and a second paper ply are returned, wherein an upper steel embossing roll is coupled with an upper embossing rubber counter-roll and a lower steel embossing roll is coupled with a lower rubber embossing counter-roll, and also including a glue delivery assembly, in contact on a side of the upper steel embossing roll, and a coupling roll, in contact with the opposite side of the upper steel embossing roll, wherein the surface of the upper steel embossing roll and/or of the lower steel embossing roll is heated with a heating device directly associated therewith. A relative embossing and lamination method is also disclosed.

11 Claims, 2 Drawing Sheets

(56) References Cited

U.S. PATENT DOCUMENTS

| | | | | |
|---|---|---|---|---|
| 5,294,475 | A | 3/1994 | McNeil | |
| 5,356,364 | A | 10/1994 | Veith et al. | |
| 5,913,765 | A | 6/1999 | Burgess et al. | |
| 6,245,414 | B1 * | 6/2001 | Biagiotti | B31F 1/07 428/172 |
| 6,913,673 | B2 | 7/2005 | Baggot et al. | |
| 2005/0051453 | A1 * | 3/2005 | Schuler | B65B 51/16 206/528 |
| 2006/0278357 | A1 | 12/2006 | Suzuki et al. | |
| 2009/0134534 | A1 | 5/2009 | Koivukunnas et al. | |
| 2010/0028611 | A1 * | 2/2010 | Adie | B32B 38/06 156/219 |
| 2010/0183850 | A1 | 7/2010 | Sauter et al. | |
| 2011/0020605 | A1 | 1/2011 | Suzuki et al. | |
| 2011/0024947 | A1 * | 2/2011 | Schulz | B32B 3/28 264/284 |
| 2012/0156447 | A1 * | 6/2012 | Hein | D21H 27/02 156/219 |
| 2013/0220151 | A1 | 8/2013 | Sauter et al. | |

FOREIGN PATENT DOCUMENTS

| | | | | |
|---|---|---|---|---|
| EP | 3 272 512 | A1 | 1/2018 | |
| JP | 2007-136861 | A | 6/2007 | |
| JP | 2012-110407 | A | 6/2012 | |
| WO | WO 2006/133389 | A2 | 12/2006 | |
| WO | WO 2007/107167 | A1 | 9/2007 | |
| WO | WO-2008069147 | A1 * | 6/2008 | A47L 13/16 |
| WO | WO 2018/229676 | A1 | 12/2018 | |
| WO | WO 2019/031159 | A1 | 2/2019 | |

OTHER PUBLICATIONS

Extended European Search Report dated Aug. 27, 2020 in European Patent Application No. 20177975.8, 8 pages.

Third Party Observations issued Feb. 17, 2021 in European Patent Application No. 20177975.8, 20 pages.

* cited by examiner

EMBOSSING AND LAMINATION ASSEMBLY AND RELATIVE EMBOSSING AND LAMINATION METHOD

BACKGROUND OF THE INVENTION

Field of the Invention

The present invention relates to an embossing and lamination assembly and a relative embossing and lamination method.

Description of the Related Art

The coupling of various plies, generally two or three plies, of so-called tissue paper is known, for making rolls of multi-ply laminated tissue paper, both for toilet paper and kitchen paper, through a so-called embossing and lamination process, in which protuberances are obtained on each of the paper plies, with one or more heights, and gluing material is applied in proximity to at least part of such embossings for the coupling of the two plies.

The transformation of individual plies of paper through hot embossing subject to a paper wetting process is also known for so-called tissue paper.

In this case, during the embossing, the paper undergoes plastic deformation thanks to the added water in addition to the humidity already generally contained in the plies of smooth paper coming from paper mills, such humidity being estimated at around 2-5%. This allows the original characteristics of the paper itself to be better preserved. The effect on the consistency of the paper that acquires improved characteristics in terms of volume, resistance, softness, absorbency and stability is particularly advantageous.

It is currently known, for example from patent no. EP1731296B1, that rolls of "tissue" type paper are made through a method of micro-embossing of paper plies that have been previously wet or onto which a lotion with a wetting effect has been previously applied.

The term micro-embossing means that the paper plies are embossed through a roll, or micro-embossing roll, and the related counter-roll, which has reliefs substantially equally distributed on its side surface, where the reliefs have heights generally less than half a millimetre. Micro-embossing is therefore distinguished from traditional embossing in the general sense, which involves the provision, through embossing profiles, of embossings with greater heights and generally having patterns that also have an aesthetic effect.

Patent application WO2018/229676A1, by the same Applicant, proposed to integrate, directly in a line for transforming tissue paper, such as so-called "converting" lines, a wetting unit and a hot paper micro-embossing device, wherein the paper is dried at the same time as the micro-embossing, for each of the plies treated. The individual paper plies, hot micro-embossed after wetting, are then fed to a traditional embossing and lamination device, comprising two pairs of rubber/steel rolls and a glue dispenser.

With respect to the hot micro-embossing, after wetting of individual plies, wound into spools, the integration of this process into a converting line has made it possible to prevent the need for the supply of a dedicated machine or of spools of already pretreated tissue paper.

However, this solution requires, with respect to a traditional converting line, the addition of a wetting station and a hot micro-embossing group with the consequent increase in the dimensions of the line and the cost of supply and maintenance of the additional devices.

BRIEF SUMMARY OF THE INVENTION

The aim of the present invention is that of realizing an embossing and lamination assembly and a related embossing and lamination method that enables tissue paper to be realized with high characteristics in particular in terms of volume, reducing the number of necessary stations and process steps.

Another aim of the present invention is that of realizing an embossing and lamination assembly and relative embossing and lamination method that is flexible to the different possible requirements of embossing one or both of the plies according to different types of embossing, such as micro-embossing, macro-embossing or double height embossing.

Another aim of the present invention is that of realizing an embossing and lamination assembly and relative embossing and lamination method that is particularly simple and functional, with contained costs.

These aims according to the present invention are reached by realizing an embossing and lamination assembly and relative embossing and lamination method as set out in the independent claims.

Further features are comprised in the dependent claims.

BRIEF DESCRIPTION OF THE SEVERAL VIEWS OF THE DRAWINGS

The characteristics and advantages of an embossing and lamination assembly and relative embossing and lamination method according to the present invention shall become clearer from the following exemplifying and not limiting description, with reference to the attached schematic drawings in which.

DETAILED DESCRIPTION OF THE INVENTION

Figure 1:
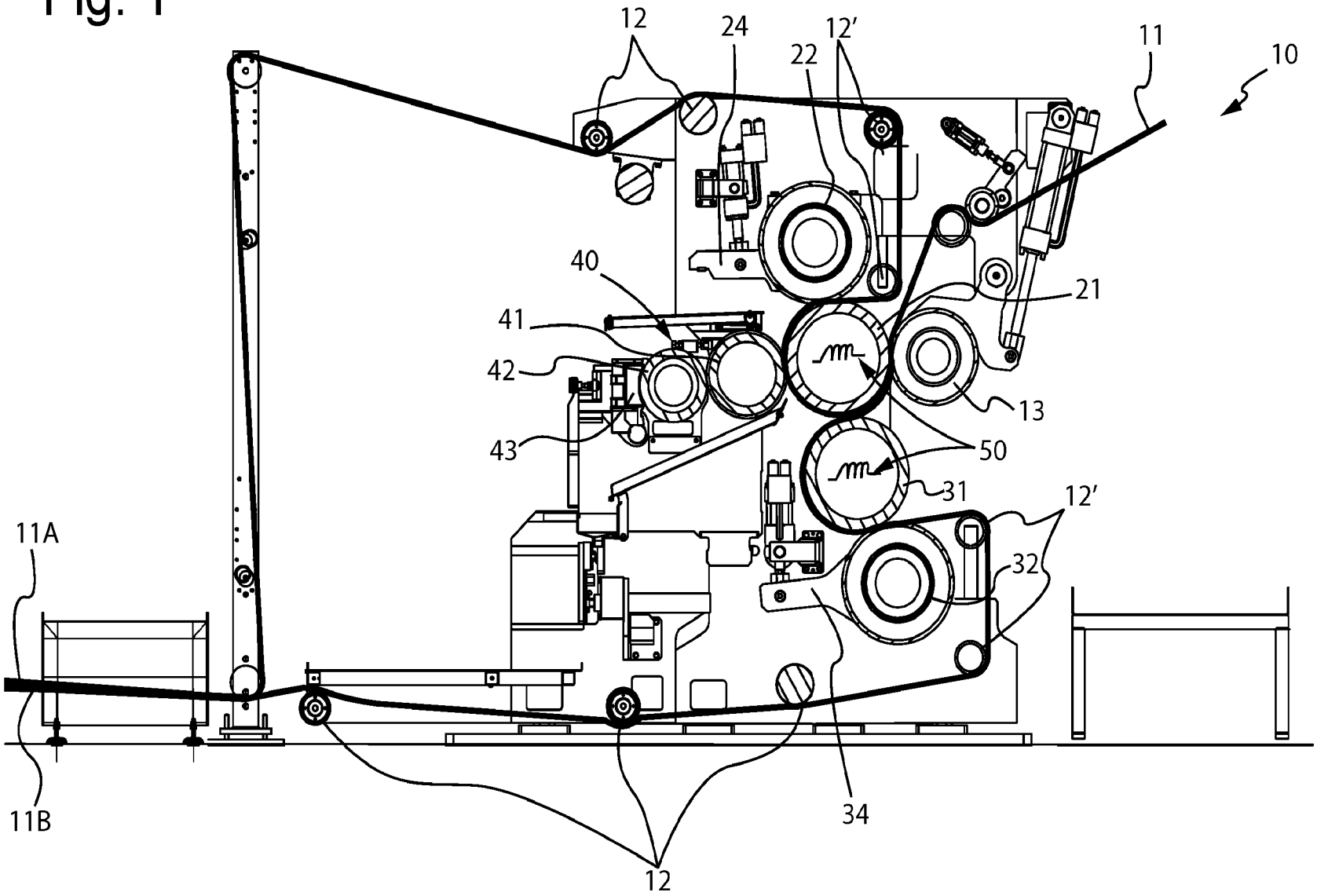
FIG. 1 is a schematic view of an embossing and lamination assembly according to the present invention.

With reference to the figures, an embossing and lamination assembly is shown indicated overall by reference 10, depicted and described according to the exemplifying and not limiting embodiment that processes two plies 11A, 11B of paper for forming multi-ply laminated tissue paper 11.

The embossing and lamination assembly 10 comprises two pairs of steel/rubber rolls, respectively comprising an upper steel embossing roll 21 and an upper embossing rubber counter-roll 22, a lower steel embossing roll 31 and a lower rubber embossing counter-roll 32, between which the first paper ply 11A and the second paper ply 11B are respectively returned, with the aid of relative motorized and/or non-motorized return rolls 12.

The upper steel embossing roll 21 can be alternatively provided with projections defining micro-embossings, macro-embossings or embossings of double height or varied height, i.e. arranged according to two or more different heights.

"Projections defining micro-embossings" means projections of equal height possibly defining a decorative pattern, e.g. obtained with a steel embossing roll with a density of peaks per $cm^2$ greater than 40 (up to 100) and with peak dimensions less than 0.7 mm.

"Projections defining macro-embossings" means projections of equal height possibly defining a decorative pattern, e.g. obtained with a steel embossing roll with a density of peaks per $cm^2$ less than 40 (up to 15) and with peak dimensions greater than 0.7 mm (up to 1 mm).

"Projections defining double height embossings" generally means projections of different heights, wherein the glue is dispensed onto the projections with the greatest height and the projections with the lowest height generally define a microembossed pattern.

Following the passage of the first paper ply 11A between the upper pair of rolls, consisting of the steel embossing roll 21 and the embossing rubber counter-roll 22, the projections of the upper steel roll 21 impress onto the first paper ply 11A relative protuberances, having the same height or different heights.

In the embossing and lamination assembly 10 the upper steel embossing roll 21 is on one side in abutment with a glue delivery assembly 40 and on the opposite side in abutment with the coupling roll 13, known as the marriage roll. In particular, the upper steel embossing roll 21 is in abutment with a glue delivery applicator 41, known as the cliché roll, which distributes onto the embossed paper ply the glue that was transferred thereto by the screen roll 42, in turn also coupled with a tank of glue 43. In particular, the cliché roll 41 distributes the glue onto the protuberances impressed by embossing on the first paper ply 11A.

The marriage roll 13, adjacent to the upper embossing roll 21 exerts coupling pressure for performing the definitive coupling between the first ply 11A and said second ply 11B at the glue deposits, thus forming multi-ply laminated tissue paper 11.

In the case in which the upper steel roll 21 is double height, following the passage of the first paper ply 11A between the pair of steel/rubber rolls, the projections with the greatest height of the upper steel roll 21 impress onto the first paper ply 11A protuberances defining a decorative pattern having a first height and the projections with a lower height impress onto the same paper ply 11A protuberances with a lower height defining a dotted background pattern, known as micro-embossing. In this particular case, the glue is applied by the cliché roll 41 onto the protuberances with the greatest height of the first embossed paper ply 11A. On the opposite side the marriage roll 13 presses the two paper plies 11A and 11B against each other to ensure the gluing thereof to form the multi-ply laminated tissue paper 11.

The lower steel embossing roll 31 is generally provided with projections all of the same height. Following the passage of the second paper ply 11B between the lower pair comprised of the steel embossing roll 31 and the rubber embossing counter-roll 32, the projections of the lower embossing roll 31 impress onto the second paper ply 11B protuberances of a constant height defining a dotted background pattern, known as micro-embossing.

The embossing and lamination assembly 10 according to the invention comprises heating means 50 for heating the surface of the upper steel roll 21 and/or the surface of the lower steel roll 31, associated with the upper steel roll 21 and/or the lower steel roll 31.

The heating means 50 for heating the steel rolls 21, 31 are directly associated with the upper steel roll 21 and/or the lower steel roll 31 for heating the upper steel roll 21 and/or the lower steel roll 31 and bringing the surface of the steel roll 21, 31 wrapped by the paper plies 11A and 11B to a temperature comprised between about 100° C. and 200° C.

The heating means 50 may be selected from the known ones, either housed within the steel roll for heating by conduction from the inside the side surface of the steel roll, or housed outside the roll and facing the side surface of the steel roll for heating by radiation and/or convection.

For example, the heating means 50 may comprise an electrical resistor appropriately buried in the steel roll, or an oil, water or steam heating circuit, also in part obtained inside the steel roll itself.

According to a preferred embodiment of the invention, it is sufficient to place the heating means 50 only associated with the lower steel roll 31. This solution is advantageously simpler in terms of construction, as the lower steel roll 31 is only coupled to the relative lower rubber roller 32 and is therefore simpler to equip with the heating means 50 both in terms of dimensions and in terms of thermal interaction with other components of the machine.

Further solutions of the present invention envisage that both steel rolls are equipped with heating means 50 or possibly that the heating means 50 are only associated with the upper steel roll 21.

In the embossing and lamination assembly 10 according to the invention, the upper 22 and/or lower 32 rubber rolls are preferably mounted on a movable arm 24, 34 when the relative steel roll 21, 31 coupled thereto is equipped with heating means 50. In fact, in the event of machine stop, it is advantageous to proceed to distance the rubber roll from the heated steel roll, so as not to ruin the rubber surface thereof due to the high temperature.

FIG. 1 shows by way of example a solution comprising further return rolls 12' arranged both around the upper rubber roll 22, which is coupled to the upper embossing roll 21, and around the lower rubber roll 32, which is coupled to the lower embossing roll 31, to guarantee the tangential passage of paper between the two coupled rolls without wrapping the respective rubber roll 22, 32. In this way, the rubber roll 22, 32 can be easily distanced from the steel roll 21, 31 coupled thereto also when the paper plies 11A, 11B are in the machine.

Figure 2:
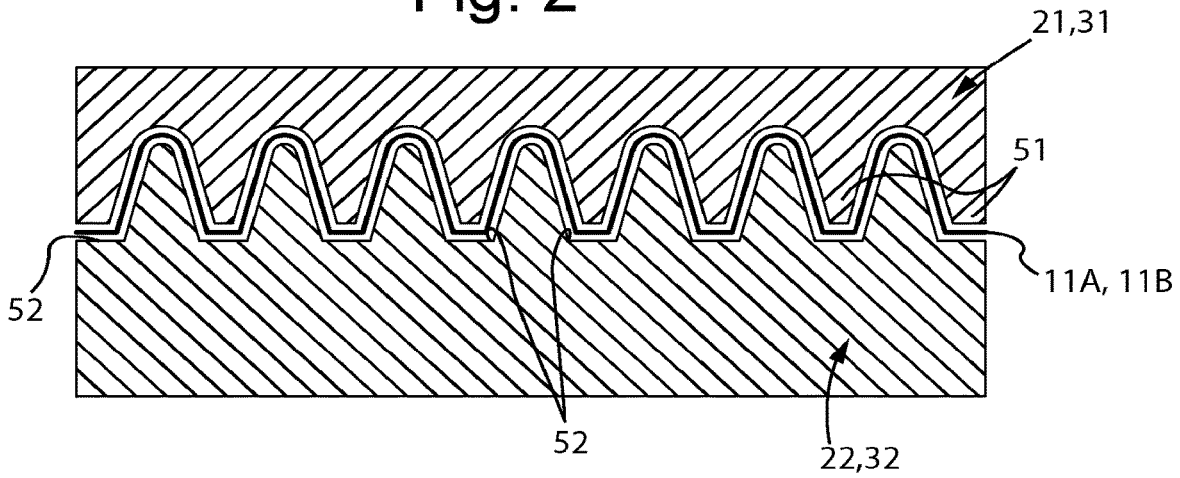
FIG. 2 schematically shows in section the coupling between the plurality of specular and mutual inter-penetrating reliefs and incisions in a pair of steel/rubber rolls.

Furthermore, according to a preferred embodiment, shown schematically in the section of FIG. 2 at least one of the two pairs comprised of an upper steel embossing roll 21 and an upper rubber embossing counter-roll 22 and/or lower steel embossing roll 31 and lower rubber embossing counter-roll 32 comprises on the side surface thereof a plurality of specular reliefs 51 and incisions 52.

The plurality of specular reliefs 51 and incisions 52 are coupled during the embossing of the ply 11A, 11B with mutual inter-penetration according to a male/female coupling.

The steel rolls preferably have the reliefs 51; the rubber rolls the specular hollows 52.

Figure 3:
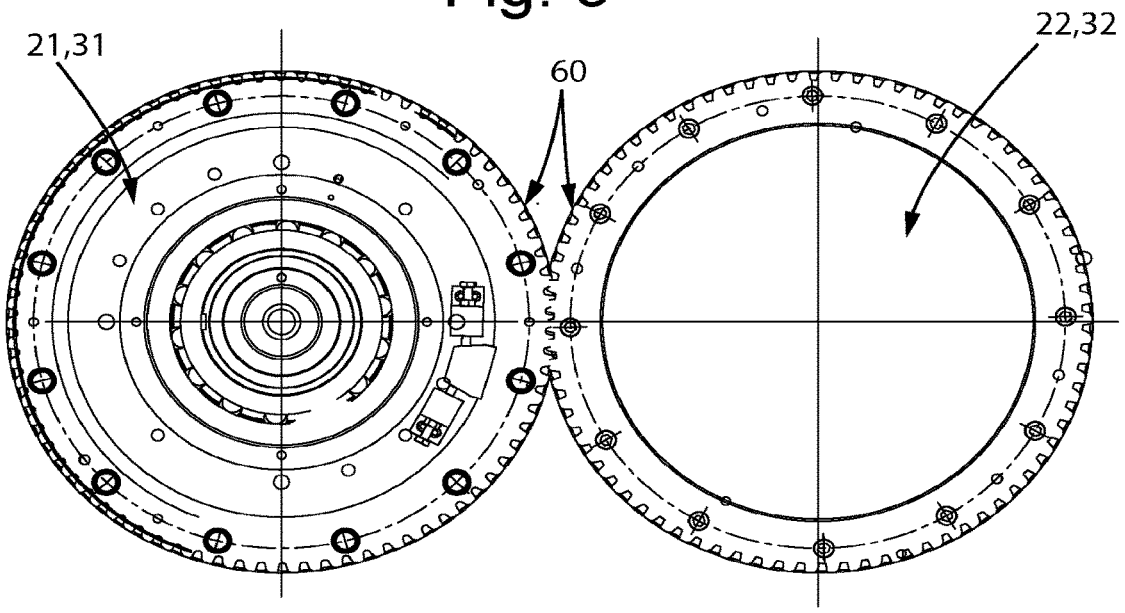
FIG. 3 shows a pair of gears that drag the rubber roller in rotation taking the motion from the steel roll.

The rubber embossing roll 22, 32 according to this embodiment, is not idle, i.e. drawn by the steel roll against which it presses, rather motorized by means of a pair of gears 60, preferably with helical teeth with recovery of clearance, which take the rotation motion from the steel roll 21, 31 (FIG. 3).

Each of the pairs of steel/rubber embossing rolls provided with specular reliefs 51 and incisions 52 must maintain the gears 60 in a meshed configuration, but not engaged when the rubber roll 22, 32 is open and therefore not in contact with the steel roll 21, 31 for example in the event of machine stop.

In work conditions, i.e. with the rubber embossing roll 22, 32 closed, the pair of steel/rubber rolls 21/22, 31/32, provided with specular reliefs 51 and protuberances 52, can advantageously operate with an adjustable distance between them, which will provide higher or lower pressure as a function of the desired result on the paper.

The reduction of embossing pressure between the steel/rubber rolls notably reduces the harmful effects caused by traditional embossing.

The Applicant has surprisingly noted that the embossing performed with complementary incisions and reliefs associated with a heated steel roll is more defined on the paper with a greater thickness achievable on the ply. The embossing is maintained at high speeds, instead of dropping as the speed increases like for traditional embossing.

Less power is used for the rolling of the rolls thanks to the "zero pressure" between the steel roll and the rubber roll, as the rubber roll is adjacent to the steel roll but generally not pressed thereon.

According to the invention, a relative embossing and lamination method of multi-ply tissue paper 11 comprising at least two paper plies 11A, 11B envisages applying heat to at least one of the upper 11A and/or lower 11B paper plies, while it is rolled onto the upper 21 and/or lower 31 steel rolls, respectively.

According to the invention, the heating of the paper ply 11A, 11B is performed at the same time as the embossing.

The embossing and laminating method for multi-ply laminated tissue paper 11 comprising multiple paper plies 11A, 11B according to the invention comprises the steps of conveying a first paper ply 11A between an upper steel embossing roll 21 and an upper rubber embossing counter-roll 22 to emboss first protuberances on the first paper ply 11A;

conveying a second ply paper 11B between a lower steel embossing roll 31 and a lower rubber embossing counter-roll 32 to emboss second protuberances on the second paper ply 11B;

applying glue by a glue delivery assembly 40 on the protuberances realized by embossing on the first paper ply 11A;

pressing the two paper plies 11A, 11B one against the other by the coupling roll 13 acting against the upper steel embossing roll 21, wherein at least one from among the steps of embossing a first paper ply 11A and/or embossing a second paper ply 11B is performed on the relative first paper ply 11A and/or on the second paper ply 11B heated by direct contact with the hot surface of the upper 21 and/or lower 31 steel embossing roll.

According to the embodiment comprising at least one pair of steel/rubber embossing rolls with inter-penetrating incisions and reliefs, the step of embossing the first paper ply 11A and/or embossing the second paper ply 11B is performed by making the paper ply 11A, 11B assume the shape of both the rolls between which it passes, i.e. the shape of the plurality of specular and inter-penetrating incisions 51 and reliefs 52 envisaged on the surfaces thereof.

The Applicant has surprisingly discovered that already the effects of the hot embossing only, even when unaccompanied by prior wetting, enable more effective embossing to be achieved.

The main effects of the hot embossing according to the invention are obtained in terms of the volume of the coupled paper 11, known as bulk, which allows larger final diameters of the wound paper roll to be obtained, and surprisingly such as to make the inevitable reduction of the tensile strength of the paper 11 acceptable compared with the results of hot embossing subject to wetting.

The embossing and lamination assembly and relative embossing and lamination method according to the present invention have the advantage of obtaining a significant increase in the volume of the roll wound simply with the minimum addition of components with respect to traditional embossing and laminating assemblies.

This advantageously allows existing assemblies to be provided with heated steel rollers and the embossing and lamination assembly to be replaced with one according to the invention in existing lines with equivalent dimensions.

The embossing and lamination assembly and relative embossing and lamination method thus conceived are subject to numerous modifications and variants, all falling within the scope of the invention; furthermore, all of the details can be replaced by technically equivalent elements. In practice, the materials used, as well as the dimensions thereof, can be of any type according to the technical requirements.

The invention claimed is:

1. An embossing and lamination assembly comprising:

two pairs of steel/rubber embossing rolls, between which respectively a first paper ply and a second paper ply are returned, wherein an upper steel embossing roll is coupled with an upper embossing rubber counter-roll, and a lower steel embossing roll is coupled with a lower rubber embossing counter-roll;

a glue delivery assembly in contact on a first side of said upper steel embossing roll;

a coupling roll in contact with a second side of said upper steel embossing roll opposite the first side of said upper steel embossing roll; and, return rolls arranged around the upper rubber embossing counter-roll and around the lower rubber embossing counter-roll to guarantee a tangential passage of paper between the two pairs of steel/rubber embossing rolls without wrapping the respective rubber embossing counter-roll, wherein a surface of at least one of said upper steel embossing roll or said lower steel embossing roll is heated with heating means directly associated therewith, and wherein said heating means are configured to bring the surface of at least one of said upper steel embossing roll or said lower steel embossing roll to a temperature comprised between about 100° C. and 200° C., and wherein at least one of the upper rubber embossing counter-roll or the lower rubber embossing counter-roll is mounted on a movable arm.

2. The embossing and lamination assembly according to claim 1, wherein only the lower steel embossing roll is equipped with said heating means or only the upper steel embossing roll is equipped with said heating means.

3. The embossing and lamination assembly according to claim 1, wherein both the upper steel embossing roll and the lower steel embossing roll are each equipped with an own heating means.

4. The embossing and lamination assembly according to claim 1, wherein said heating means are provided inside the at least one of the upper steel embossing roll or the lower steel embossing roll.

5. The embossing and lamination assembly according to claim 1, wherein said heating means are provided outside the at least one of the upper steel embossing roll or the lower steel embossing roll.

6. The embossing and lamination assembly according to claim 1, wherein at least one of the two pairs of steel/rubber embossing rolls comprises on a side s face thereof a plurality of specular reliefs and incisions, adapted to be coupled with mutual inter-penetration according to a male/female coupling.

7. The embossing and lamination assembly according to claim 6, wherein at least one of the upper and lower steel embossing rolls include reliefs and at least one of the upper and lower rubber embossing counter-rolls have incisions.

8. The embossing and lamination assembly according to claim 7, wherein the at least one of the upper and lower rubber embossing counter-rolls bearing incisions is dragged by the at least one of the upper and lower steel embossing rolls through a pair of gearings.

9. A embossing and lamination method of multi-ply laminated tissue paper comprising a plurality of paper plies comprising:

conveying a first paper ply between an upper steel embossing roll and an upper rubber embossing counter-roll to emboss first protuberances on the first paper ply;

conveying a second paper ply between a lower steel embossing roll and a lower rubber embossing counter-roll to emboss second protuberances on the second paper ply;

applying glue by a glue delivery assembly on the first protuberances realized by embossing on the first paper ply;

pressing the first and second paper plies one against the other by a coupling roll acting against the upper steel embossing roll, wherein at least one of the embossing the first paper ply or embossing the second paper ply is performed on at least one of the first paper ply or the second paper ply, heated by direct contact with a hot surface of at least one of the upper steel embossing roll or the lower steel embossing roll, wherein the heating of the at least one of the first paper ply or the second paper ply is carried out heating the at least one of the upper steel embossing roll or the lower steel embossing roll to a temperature comprised between about 100° C. and 200° C., wherein at least one of the upper rubber embossing counter-roll or the lower rubber embossing counter-roll is mounted on a movable aim, and wherein return rolls are arranged around the upper rubber embossing counter-roll and around the lower rubber embossing counter-roll to guarantee a tangential passage of paper between the two pairs of steel rubber embossing rolls without wrapping the respective rubber embossing counter-roll.

10. The embossing and lamination method according to claim 9, wherein the heating of the at least one of the first paper ply or the second paper ply is carried out at the same time as the embossing.

11. The embossing and lamination method according to claim 9, wherein at least one of the embossing the first paper ply or embossing the second paper ply is performed 1*w* making the at least one of the first paper ply or the second paper ply assume a shape of a plurality of specular and inter-penetrating incisions and reliefs on surfaces of the at least one of the upper steel embossing roll or the lower steel embossing roll and the at least one of the upper rubber embossing counter-roll or the lower rubber embossing counter-roll.

* * * * *